US006550073B2

(12) United States Patent
Hellwig et al.

(10) Patent No.: US 6,550,073 B2
(45) Date of Patent: Apr. 22, 2003

(54) ARTICULATION FOR A TOILET SEAT

(75) Inventors: Jorg Hellwig, Frasdorf (DE); Rudolf C. Hamberger, Stephanskirchen (DE)

(73) Assignee: Hamberger Industriewerke GmbH, Stephanskirchen (DE)

( * ) Notice: Subject to any disclaimer, the term of this patent is extended or adjusted under 35 U.S.C. 154(b) by 0 days.

(21) Appl. No.: 09/910,884

(22) Filed: Jul. 24, 2001

(65) Prior Publication Data

US 2002/0062518 A1 May 30, 2002

(30) Foreign Application Priority Data

Oct. 18, 2000 (DE) ..... 100 51 805

(51) Int. Cl.[7] ..... A47K 13/12
(52) U.S. Cl. ..... 4/236; 4/248
(58) Field of Search ..... 4/236, 240, 248

(56) References Cited

U.S. PATENT DOCUMENTS

| | | | | | |
|---|---|---|---|---|---|
| 1,132,255 | A | * | 3/1915 | Getty et al. | 4/236 X |
| 2,283,892 | A | * | 5/1942 | Leslie | 4/240 |
| 2,474,164 | A | * | 6/1949 | Riemer | 4/248 X |
| 5,142,740 | A | * | 9/1992 | Amaki et al. | 4/236 X |
| 5,996,132 | A | | 12/1999 | Sorimachi | 4/236 |
| 6,009,568 | A | | 1/2000 | Miyazaki | 4/236 |

FOREIGN PATENT DOCUMENTS

| | | |
|---|---|---|
| DE | 3437138 A1 | 4/1986 |
| DE | 3701720 C2 | 8/1988 |
| DE | 44 09 516 | 8/1994 |
| EP | 0 787 459 A1 | 8/1997 |
| JP | 8-312694 | 11/1996 |
| JP | 10201670 A | 8/1998 |
| WO | WO 99/63874 | 12/1999 |
| WO | WO 99/63875 | 12/1999 |

* cited by examiner

*Primary Examiner*—Robert M. Fetsuga
(74) *Attorney, Agent, or Firm*—Oliff & Berridge, PLC

(57) ABSTRACT

An articulation for a toilet seat for securing a seat assembly to a ceramic body, wherein the lowering movement of the seat assembly may be braked with the aid of a damping means. The damping means is connected via an adapter member with the fastening means of the seat assembly, wherein adapter member and damping means form the rotation axis for the seat assembly.

8 Claims, 2 Drawing Sheets

ARTICULATION FOR A TOILET SEAT

The invention relates to an articulation for a toilet seat in accordance with the preamble of claim 1.

A like articulation for a toilet seat is, for example, known from U.S. Pat. No. 5,996,132. In this solution, the seat and the seat cover are mounted along a rotation axis, wherein the lowering movement of the seat and of the seat cover, respectively, may be controlled by a damping means including a spring-biased cam mechanism and a fluid damper.

The combination of spring-biased cam mechanism and fluid damper requires considerable expenditure in terms of device technology, so that the overall price of the toilet seat is quite considerably influenced by the articulation.

In U.S. Pat. No. 6,009,568 an articulation for a toilet seat is disclosed wherein the seat and the seat cover are designed to each include separate rotation axes. Although by this separate design of the rotation axes a more uniform guidance of seat and seat cover is made possible, in this variant nevertheless considerable space is required for constructing the two rotation axes having an offset arrangement with the corresponding damping means.

WO 99/63875 A1 and WO 99/63874 A1 also disclose articulations for a toilet seat, wherein the seat and the seat cover are arranged on a common rotation axis. This rotation axis is formed by two shaft pins guiding the seat and the seat cover, which co-operate with a damping means having the form of spring members. These shaft pins are coupled via a connecting mechanism making it possible to detach the assembly from the ceramic body.

It is a drawback in the aforedescribed solutions that considerable expenditure in terms of device technology is necessary in order to form the rotation axis of the seat assembly.

In contrast, the invention is based on the objective of furnishing an articulation for a toilet seat which makes reliable dampening of the lowering movement of a seat or seat cover possible at minimum expenditure in terms of device technology.

This objective is attained through an articulation for a toilet seat having the features of claim 1.

In accordance with the invention, a rotation axis of a toilet seat assembly is formed by a damping means connected to the ceramic body-side gudgeons through an adapter member. The damping means is positively connected to the adapter member and received in a reception bore of the toilet seat assembly, wherein the damping means is positively connected either to the seat or to the seat cover of the WC-assembly, so that optionally the movement of the seat or of the seat cover is braked.

The concept of the invention differs from the above described solutions in that the rotation axes along which the toilet seat assembly may be pivoted are substantially formed by the damping means and the adapter member, in other words: the seat cover and/or the seat are mounted directly on these components, so that the expenditure in terms of device technology is considerably reduced in comparison with conventional solutions wherein rotation axis and damping means were formed by separate components.

The scope of claim 1 also encompasses solutions wherein the adapter member and the damping means are integrally formed as specially designed parts. It is, however, preferred to form the damping means of series-produced dampers as also utilized in other applications.

Axial securing of the adapter member or of the damping means is effected by means of an axial retainer, preferably inserted in the radial direction into a mounting link of the seat assembly, so that adapter member and/or damping means are secured in the axial direction with respect to the mounting link. This variant has the advantage that mounting and disassembling may be carried out with extreme simplicity by inserting and taking out the axial retainer.

In a preferred embodiment the axial retainer is formed by a spring clip which is inserted through the mounting link into an annual groove of the adapter member or of the damping means.

The damping means has a particularly compact design if it has the form of a rotation damper which, on the one hand, is in positive engagement with the seat cover or with the seat, and on the other hand is positively coupled to the adapter member via a suitable interlocking connection.

Manufacture of the seat assembly is particularly simple when the reception bore for damping means and adapter member has the form of a through bore.

Depending on whether the seat or the seat cover is to be braked, the reception bore is throughout executed with approximately the external diameter of the damping means or of the adapter member or as a stepped bore, in which a seat cover-side end portion is radially stepped back and provided with a fitting surface.

The adapter member and/or the gudgeons are preferably made of plastic or noble metal.

Further advantageous developments of the invention are the subject matters of the other subclaims.

In the following, a preferred embodiment of the invention shall be explained in more detail by way of schematic drawings, wherein.

Figure 1:
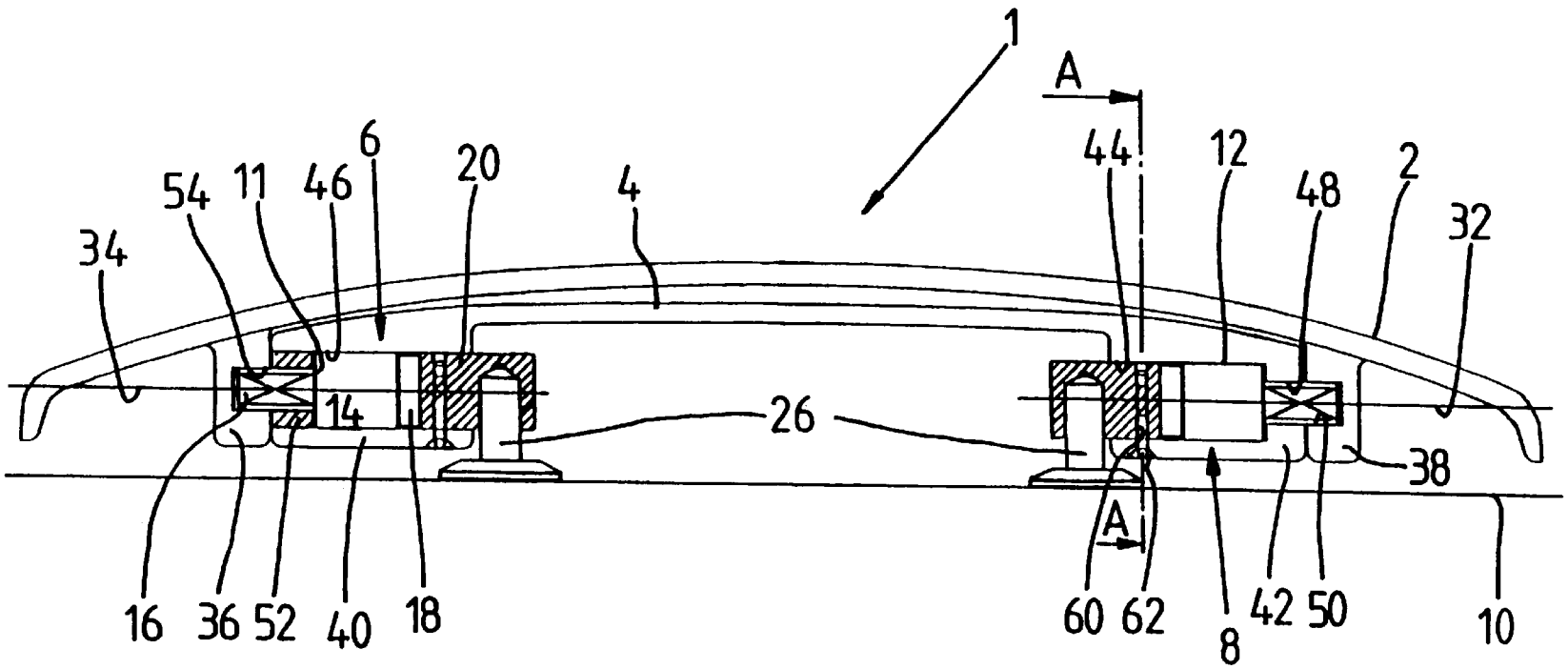
FIG. 1 is a sectional view of a toilet seat assembly.

FIG. 1 represents a sectional view of a toilet assembly 1 having a seat cover 2 and a seat 4 which are connected, with the aid of two coaxially arranged seat articulations 6, 8, with a ceramic body 10 (indicated only). The seat articulations 6, 8 are designed such that the toilet assembly 1 may be pivoted from its represented closed position by more than 90 degrees into an open position in which the seat cover 2 and/or the seat 4 rest against a stop.

Each one of the two seat articulations 6, 8 has a rotation damper 11 or 12, respectively, whereby the lowering movement of the assembly 1 is braked. The lowering movement of the seat cover 2 is braked by means of the rotation damper 11 of the seat articulation 6, and the lowering movement of the seat 4 is braked by means of the rotation damper 12 of the seat articulation 8. The rotation dampers 11, 12 are commercially available accessory parts, so that a more detailed description of their functional properties may be omitted. The braking torque of the rotation dampers 11, 12 is adapted such that the seat cover 2 and the seat 4 may slowly pivot back towards the ceramic body 10 without being manually supported.

Each rotation damper 11, 12 includes a cylinder 14 in which a rotary piston 16 is guided. The rotary piston 16 is provided with one or several bevels or recesses so that it may be taken into positive engagement with the seat cover 2 or with the seat 4. At the rear side of the cylinder 14 of each rotation damper 11, 12 which is removed from the piston 16, a diagonal projection 18 is formed, whereby a positive connection with an adapter member 20 is achieved.

Figure 2:
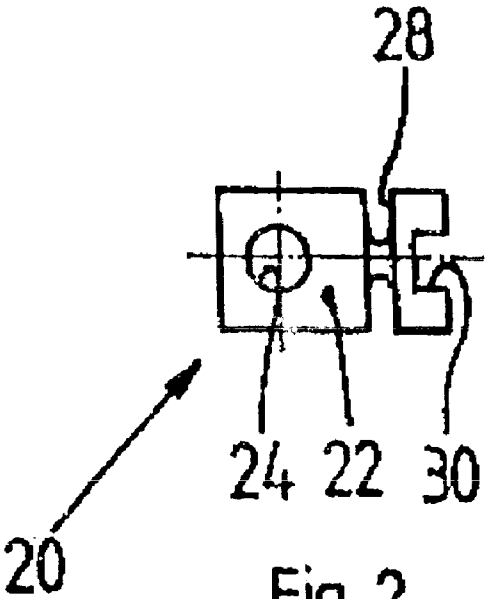
FIG. 2 is a plan view onto an adapter member of the toilet seat assembly of FIG. 1.

FIG. 2 shows a single representation of the adapter member 20 used for the hinge joints 6, 8.

In accordance with FIG. 2, the adapter member 20 includes an approximately cylindrical base body 22 in which a radial blind bore 24 is formed. The adapter member 20 may be placed via the blind bore 24 on a gudgeon 26 anchored in the ceramic body 10. Locking between the gudgeon 26 and the adapter member 20 is achieved by means of a latching connection formed, e.g., by a spring washer or O ring inserted into the inner peripheral wall of the blind bore 24 and engaging a peripheral groove (not shown) of the gudgeon 26. In other words, the entire toilet seat assembly may very rapidly be pulled off the gudgeons 26 with minimum effort.

On the outer circumference of the base body 22 there is moreover formed an annular groove 28, the function of which shall be discussed hereinbelow. In the one end face of the base body 22 adjacent the annular groove 28, a diagonally extending rectangular groove or recess 30 is provided which is engaged by the diagonal projection 18, 50 that a positive connection between the cylinder 14 of the rotation damper 11 or 12 and the adapter member 20 is established.

The adapter member 20 and the rotation cylinder 11 or 12 engaged with it each form a rotation axis 32, 34 of the seat articulations 8 and 6, respectively.

As can particularly be learned from FIG. 1, the seat cover has two external mounting links 36, 38 encompassing two internal mounting links 40, 42 of the seat 6. In the two internal mounting links 40, 42, which are formed to be somewhat wider in the axial direction than the external mounting links 36, 38, respective reception bores 44 and 46 are provided. The reception bore 44 in the internal mounting link 42 has the form of a stepped bore, with the diameter being reduced towards the external mounting link 38. In this smaller part 48 of the reception bore 44 a flattened portion conforming with the profile of the rotary piston 16 of the rotation damper 12 is formed, whereby the rotary piston 16 is positively connected with the internal mounting link 42. The rotary piston 16 extends through the flattened part 48 of the reception bore and projects into a bearing bore 50 of the external mounting link 38, wherein the diameter of the bearing bore 50 is selected such that the seat cover 2 is rotatably mounted on the rotary piston 48.

The reception bore 46 associated with the seat articulation 6 has the form of a through bore with a uniform diameter.

The end portion through which the rotary piston 16 extends has inserted a spacer sleeve 52 slidingly encompassing the rotary piston 16 of the rotation damper 11, so that the seat 4 is rotatably mounted via the reception bore 46 on the outer circumference of the adapter member 20, of the associated rotation damper 11, and of the spacer member 52. The rotary piston 16 extends through the spacer member 52 and projects into a reception 54 of the adjacent external mounting link 36, wherein the profile of the reception 54 is formed in accordance with the profile of the rotary piston 16, so that the seat cover 2 is positively connected with the rotary piston 16.

In other words, in the aforedescribed construction the seat cover 2 is braked by engagement of the external mounting link 36 with the rotation damper 11, with the rotary pistons 16 of the two rotation dampers 11, 12 acting as a rotation axis. The lowering movement of the seat 4 is braked by engagement of the rotary piston 16 of the rotation damper 12 with part 48 of the reception bore 44, with the outer circumference of the rotation dampers 11, 12, of the adapter members 20 and of the rotary pistons 16 acting as a pivotal bearing for the seat 4.

Figure 4:
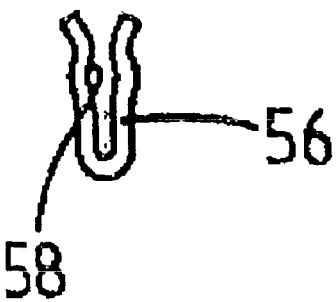
FIG. 4 is a single representation of a spring clip for axial securing.
Figure 3:
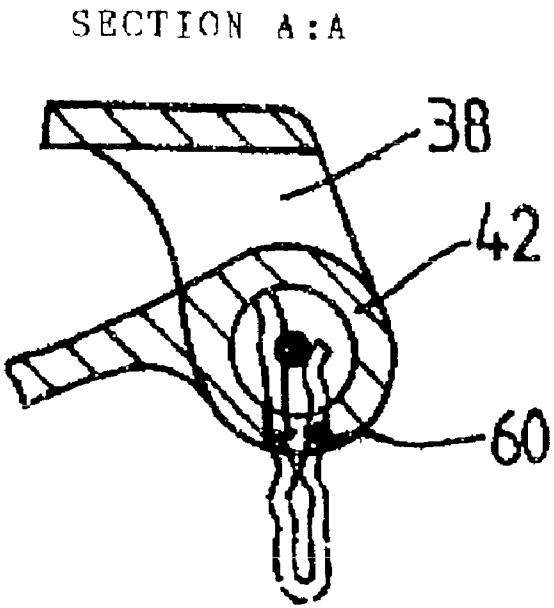
FIG. 3 shows a sectional view of the toilet seat assembly of FIG. 1 along the line A—A.

Axial securing of the two seat articulations 6, 8 is effected via a respective spring clip or retainer 56 bent, e.g., into a U shape in accordance with FIG. 4, with the ends being bent apart in a V configuration. In continuation of the V-shaped, bent-apart end portions, the two U-legs of the spring clip 56 are arcuately curved outwardly into an eyelet 58. As can particularly be seen in the section A—A in accordance with FIG. 3, the diameter of the eyelet 58 is selected such that the inner surfaces of the U-legs of the spring clip 56 frictionally or positively encompass the peripheral walls of the connecting portion of the adapter member 20 formed by the annular groove 28, wherein a relative rotation of adapter member 20 and spring clip 56 is, however, still possible. In accordance with FIG. 3, in each internal mounting link 40, 42 an insertion slot 60 extending in a radial direction is formed, through which the spring clip 56 m ay be inserted into the mounting link 40 or 42, respectively, in such a way that the eyelet 58 encompasses the central connecting portion of the adapter member 20 formed by the annular groove 28. In this way the adapter member 20 is reliably secured in the axial direction in the respective reception bore 44 or 46, with a rotary movement between adapter member 20 and seat cover 4, however, still being permitted. In accordance with FIG. 1 the insertion slot 60 is provided with a V-shaped expansion 62, whereby taking out the spring clip 56 is facilitated. FIG. 3 represents the inserting positions of the spring clip 56 (setting, sliding onto the connecting portion, encompassing the connecting portion).

For assembling the WC-assembly, initially the seat cover 2 and the seat 4 are positioned in the relative positions represented in FIG. 1 and subsequently the rotation dampers 11 and 12 are inserted into the respective reception bores 44, 46, with the rotary piston 16 of the seat articulation 6 entering into positive engagement with the external mounting link 38 and being slidingly guided in the other external mounting link 36. Accordingly, the other rotary piston 16 of the seat articulation 8 is in positive engagement with the internal mounting link 14 and thus is rotatably guided in the bearing bore. Following insertion of the rotation dampers 11, 12 the two adapter members 20 are mounted, so that the diagonal projection 18 plunges into the respective rectangular groove 30 of the rotation damper 11 or 12, respectively. In the next assembling step the spring clips 56 are inserted through the two insertion slots 60 of the internal mounting links 40 and 42, respectively, so that the leg of the spring clip 56 engages the annual groove 28 of the adapter member 20 and the eyelet 58 encompasses the connecting portion of the annual groove 28 (cf. FIG. 3). The preassembled unit is then placed on the two gudgeons 26.

Optionally, in the range between the adapter member 20 and a rosette lying on the ceramic body 10, bevels which are not represented may be formed on the gudgeons 26, against which a wrench may be placed for mounting the gudgeons 26 on the ceramic body 10.

The articulation for a toilet seat according to the invention is characterized by an extremely simple construction, wherein assembling may be carried out in very few manipulations even by a layman.

In particularly high-value modifications at least the gudgeons 26 and the adapter members 20 are made of stainless steel. In lower-grade modifications the seat articulation 6, 8 is made of plastic.

It is also possible to use other damping means instead of the represented rotation dampers 11, 12. What is essential is that the damper 11, 12 is used both for braking the lowering movement and also for guiding the seat cover 2 or the seat 4.

An articulation for a toilet seat for securing a seat assembly to a ceramic body is disclosed, wherein the lowering movement of the seat assembly may be braked with the aid of a damping means. The damping means is connected via an adapter member with the fastening means of the seat assembly, wherein adapter member and damping means form the rotation axis for the seat assembly.

List of Reference Numerals

| | |
|---|---|
| 1 | toilet assembly |
| 2 | seat cover |
| 4 | seat |
| 6 | seat articulation |
| 8 | seat articulation |
| 10 | ceramic body |
| 11 | rotation damper |
| 12 | rotation damper |
| 14 | cylinder |
| 16 | rotary piston |
| 18 | diagonal projection |
| 20 | adapter member |
| 22 | base body |
| 24 | blind bore |
| 26 | gudgeon |
| 28 | annular groove |
| 30 | rectangular groove |
| 32 | rotation axis |
| 34 | rotation axis |
| 36 | external mounting link |
| 38 | external mounting link |
| 40 | internal mounting link |
| 42 | internal mounting link |
| 44 | reception bore |
| 46 | reception bore |
| 48 | part of the reception bore |
| 50 | bearing bore |
| 52 | spacer member |
| 54 | reception |
| 56 | spring clip |
| 58 | eyelet |
| 60 | insertion slot |

What is claimed is:

1. An articulation (6, 8) for a toilet seat for securing a toilet seat assembly (1) to a ceramic body (10), including a rotation axis (32, 34) for a seat (4) and a seat cover (2) of said seat assembly (1) and including a coaxially arranged damping means (11, 12) for supporting said seat assembly (1) during a pivoting movement, characterized by a cylindrical adapter member (20) which may be placed via a radial blind bore (24) in said adaptor member (20) on a gudgeon (26) anchored in said ceramic body (10) at a first end along the rotation axis (32, 34) on the one hand, and positively connected with the coaxially arranged damping means (11, 12) on the other hand, and fastened in a reception bore (44, 46) of a mounting link (40, 42) of said seat assembly (1) at a second end along the rotation axis (32, 34), wherein said seat cover (2) and said seat (4) are pivotable on said adapter member (20) and said damping means (11, 12) with respect to said rotation axis (32, 34), and said damping means (11, 12) comprises a cylinder (14) in which a rotary piston (16) is guided.

2. The articulation for a toilet seat in accordance with claim 1, wherein said adapter member (20) is fixed in said reception bore (44, 46) by means of an axial retainer (56) which at least in portions extends through said mounting link (40, 42).

3. The articulation for a toilet seat in accordance with claim 2, wherein said mounting link (40, 42) has an insertion slot (60) opening in said reception bore (44, 46), into which a spring clip (56) plunging into an annular groove (28) of said adapter member (20) is inserted.

4. The articulation for a toilet seat in accordance with claim 1, wherein said damping means is a rotation damper (11, 12) having at its end portion removed from said adapter member (20) a rotary piston (16) which is in positive engagement with said seat (4) or said seat cover (2).

5. The articulation for a toilet seat in accordance with claim 4, wherein said rotation damper (11, 12) at its end portion removed from said rotary piston (16) has a diagonal projection (18) which plunges into a correspondingly formed recess (30) of said adapter member (20).

6. The articulation for a toilet seat in accordance with claim 4, wherein said reception bore (46) has the form of a through bore, and into the one end portion removed from said gudgeon (26) a spacer sleeve (52) is inserted through which a rotary piston (16) extends so as to be rotatable, wherein a part of said rotary piston (16) projecting from said spacer sleeve (52) is positively received in said seat cover (2).

7. The articulation for a toilet seat in accordance with claim 4, wherein said reception bore (44) has the form of a stepped bore, wherein a part (48) of said reception bore (44) removed from said gudgeon (26) is radially stepped back and positively engages said rotary piston (16), and a part of said rotary piston (16) projecting from said reception bore (44) is rotatably received in a bearing bore (50) of said seat cover (2).

8. The articulation for a toilet seat in accordance with claim 1, wherein adapter member (20) and gudgeon (26) are made of stainless steel or plastic.

* * * * *